US005518128A

United States Patent [19]

Kröll et al.

[11] Patent Number: 5,518,128

[45] Date of Patent: May 21, 1996

[54] CRANE, PARTICULARLY RAILWAY CRANE

[75] Inventors: Joachim Kröll, Jüchen; Walter Köllner, Korschenbroich, both of Germany

[73] Assignee: Mannesmann Aktiengesellschaft, Dusseldorf, Germany

[21] Appl. No.: 433,828

[22] Filed: May 4, 1995

Related U.S. Application Data

[63] Continuation-in-part of Ser. No. 148,663, Nov. 5, 1993, abandoned.

[30] Foreign Application Priority Data

Nov. 6, 1992 [JP] Japan ..... 42 37 948.2

[51] Int. Cl.[6] ..... B66C 23/76

[52] U.S. Cl. ..... 212/196

[58] Field of Search ..... 212/158, 178, 212/195, 196, 197, 279

[56] References Cited

FOREIGN PATENT DOCUMENTS

| | | | |
|---|---|---|---|
| 554265 | 6/1932 | Germany | 212/195 |
| 1812223 | 9/1969 | Germany | 212/195 |
| 1928461 | 12/1969 | Germany | 212/195 |
| 202259 | 12/1954 | Switzerland | 212/195 |
| 471289 | 8/1975 | U.S.S.R. | 212/195 |
| 749792 | 7/1980 | U.S.S.R. | 212/195 |
| 2159122 | 11/1985 | United Kingdom | 212/196 |
| 2222572 | 3/1990 | United Kingdom | 212/196 |

*Primary Examiner*—William E. Terrell
*Assistant Examiner*—Thomas J. Brahan
*Attorney, Agent, or Firm*—Cohen, Pontani, Lieberman, Pavane

[57] ABSTRACT

A crane, particularly a railway crane, with a superstructure which is arranged on an undercarriage so as to be swivelable around a vertical axis, a jib and at least one counterweight which is movable as a function of the swiveling movement of the superstructure. The counterweight being arranged on the superstructure. The at least one counterweight is connected with the superstructure via an articulation which has a swivel axis aligned parallel to the vertical axis of the superstructure.

6 Claims, 5 Drawing Sheets

CRANE, PARTICULARLY RAILWAY CRANE

This is a continuation-in-part of application Ser. No. 08/148,663, filed Nov. 5, 1993, now abandoned.

BACKGROUND OF THE INVENTION

1. Field of the Invention

The invention is directed to a crane, particularly a railway crane, with a superstructure arranged on an undercarriage so as to be swivelable around a vertical axis, a jib, and a counterweight arranged on the superstructure so as to be movable as a function of swiveling movement of the superstructure.

2. Description of the Prior Art

A revolving jib crane with a chassis or undercarriage and a superstructure arranged on the latter so as to be swivelable is known from DE 224 303 A1. The boom or jib is supported at the superstructure. Furthermore, a counterweight is arranged at the side of the superstructure remote of the jib. The counterweight is constructed so as to be displaceable in the horizontal direction in extension of the jib as seen from the top in order to change the counterweight moment. The counterweight is adjusted as a function of the swiveling movement of the superstructure. For this purpose, the counterweight is mechanically coupled with the rotating drive for the superstructure via a lever system and a toothed wheel.

The movability of the counterweight has proven disadvantageous since it increases the working radius or length of the superstructure in the rear, i.e. the distance between the swivel axis of the superstructure and the outer contour of the counterweight remote of the swivel axis. Although this increased length results in an increase in the counterweight moment and accordingly in the load carrying capacity of the crane, it is impossible to use the crane in confined spaces. A jib crane constructed as a railway crane will serve as example. Its working range is frequently limited at least on one side by a prescribed clearance gauge. The increased length renders it almost impossible to swivel this crane on a track running alongside a parallel track, since the counterweight exceeds the clearance gauge laterally in the direction of the neighboring track already at a small swiveling angle and this neighboring track must accordingly be barred to traffic.

SUMMARY OF THE INVENTION

Accordingly, it is an object of the present invention to provide a crane, in particular a railway crane, which has an improved load carrying capacity and a small rear length at the same time.

Pursuant to this object, and others which will become apparent hereafter, one aspect of the present invention resides in a crane, particularly a railway crane, in which at least one counterweight is connected with the superstructure by an articulation which has a swivel axis aligned parallel to the vertical axis of the superstructure.

In another embodiment of the invention, the swivel action of the counterweight intersects the longitudinal axis of the superstructure and is at a distance from the vertical axis of the superstructure toward the rear side of the superstructure remote from the free end of the jib.

In yet another embodiment of the invention, the counterweight can be driven opposite to the swiveling direction of the superstructure by a swiveling drive which is arranged between the superstructure and the counterweight.

In a further embodiment of the invention, the swivel angle enclosed between the longitudinal axis of the superstructure and the longitudinal axis of the undercarriage, and the swivel angle between the longitudinal axis of the superstructure and the longitudinal axis of the counterweight, are equal in a transporting position of the crane and in a preselected maximum swivel position between 20 and 40 degrees.

In still another embodiment, the swivel drive is controlled as a function of the swivel angle of the superstructure so that the swivel angle of the superstructure and the swivel angle of the counterweight are equal in amount in every swivel position of the superstructure.

In another further embodiment, a ratio of the width of the counterweight and the width of the superstructure and the distance between the vertical axis and the swivel axis are selected so that an outer contour of the superstructure and the counterweight are arranged within half the width of a clearance gauge of a travel path of the crane at a preselected maximum swivel angle of the superstructure.

In yet another embodiment, an extendable arm is provided for connecting together the counterweight and the articulation.

It is further possible to divide the counterweight longitudinally so as to define two parts which are connected with the superstructure by the articulation in the manner of a multiple-shear pin connection.

In still a further embodiment, the width of the parts of the counterweight and the distance of the swivel axis from the vertical axis and the distance between the longitudinal axis and the swivel axis are selected so that when the superstructure is swiveled to an angle of 90° relative to the longitudinal axis of the undercarriage, the parts of the counterweight which are swiveled by 90° lie within the width of a clearance gauge of a travel path of the crane.

An additional embodiment provides the counterweight with as square a shape as possible so that a sidewall of the counterweight facing the lateral plane of the clearance gauge extends parallel to the lateral plane of the clearance gauge in the swiveling position with the maximum swivel angle.

As a result of the arrangement of a counterweight at the superstructure of a railway crane which is connected via an articulation with a swivel axis aligned parallel to the vertical axis of the superstructure, the rear length of the superstructure can be reduced according to the invention in that the counterweight swivels in the opposite direction of the superstructure. The oppositely directed swiveling of the counterweight results in a change in the rear outer contour of the superstructure in such a way that, up to a preselected maximum swivel angle between 30 and 40 degrees, the rear end of the counterweight facing in the swiveling direction falls just short of penetrating the vertical lateral plane of the clearance gauge which in this case extends parallel to the longitudinal axis of the jib in the 0° position. Moreover, although the swiveling of the counterweight results in a reduction in the counterweight moment, since the center of gravity of the counterweight is moved out of the extension of the longitudinal axis of the jib, the remaining counterweight moment proves adequate to carry out a great number of required operations for a swivel angle of the superstructure between 0 and 40 degrees. Further, the limited swivel angle range in connection with the jib and the movability of the crane makes it possible to operate in a sufficiently large work area next to the track body. As a result of the uniformity between the swivel angle of the superstructure and the swivel angle of the counterweight with respect to magnitude, the moment of the counterweight decreases continuously as the swivel angle increases and is accordingly easily manageable. By selecting the width of the counterweight and the width of the superstructure as a function of a preselected maximum swivel angle of the superstructure, the outer contour of the superstructure and counterweight remains just within a clearance gauge of its travel path when the maximum swivel angle is reached. This ensures that the crane can be operated on a roadway constructed as a road or rail without hindering the oncoming traffic on a neighboring roadway. The counterweight moment can be increased by arranging the counterweight at an extendable or telescoping arm which is connected with the articulation at the superstructure. This linear extensibility of the counterweight is possible because the counterweight is only moved out within the clearance gauge of the travel path by the swiveling of the counterweight.

A further advantage of the invention is that the counterweight is divided in the longitudinal direction and each part is connected with the superstructure via an articulation which is constructed in particular as a multiple-shear pin connection so that the parts of the counterweights can be swiveled in a transverse position of the superstructure relative to the travel path in such a way that they are aligned in their longitudinal direction with the longitudinal direction of the undercarriage. Accordingly, the cringe according to the invention can also be operated in the transverse position and has a small length in the rear and a greater load carrying capacity at the same time.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
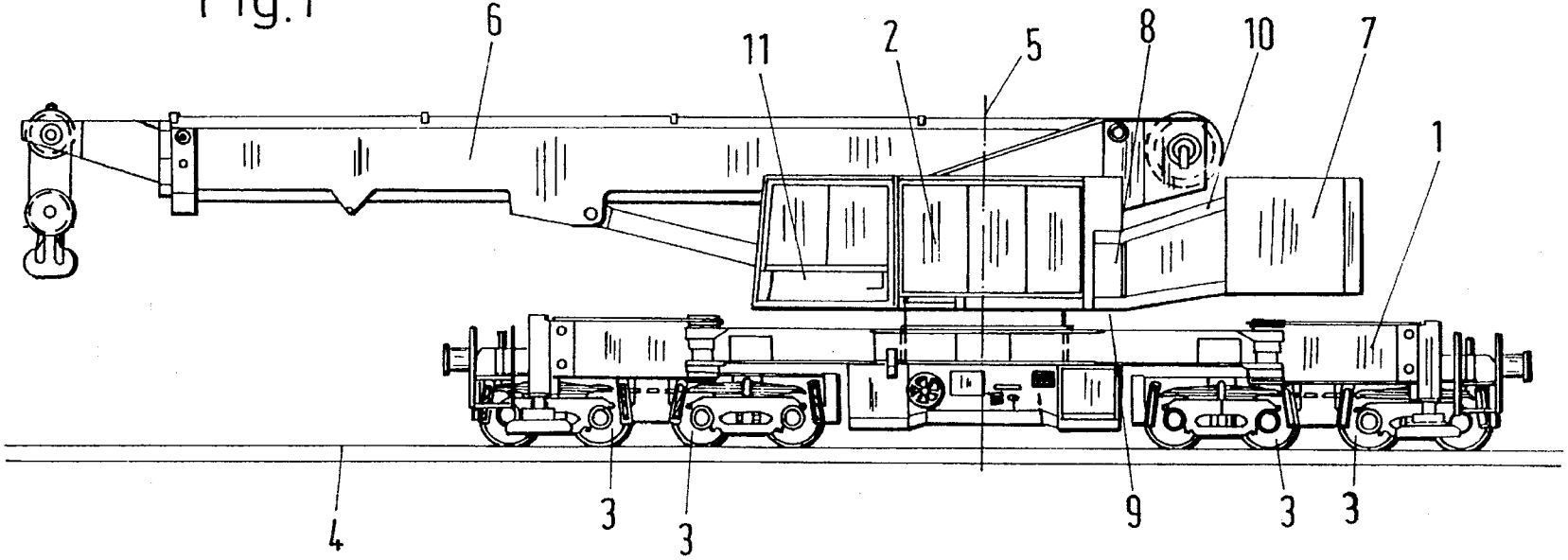
FIG. 1 shows a side view of a railway crane pursuant to the present invention.

FIG. 1 shows a side view of a railway crane according to the invention. The railway crane substantially includes an undercarriage 1 and a superstructure 2. The undercarriage 1 is movable on rails 4 via traveling mechanisms 3. The superstructure 2 is supported on the undercarriage 1 so as to be swivelable along an axis 5 aligned vertically and perpendicular to the undercarriage 1. A jib 6 which extends parallel to the longitudinal direction L (see FIG. 2) of the superstructure 2 is articulated on the superstructure 2. Also, a counterweight 7 is arranged at the end of the superstructure 2 remote of the free end of the jib 6. The counterweight 7 is connected with the superstructure 2 via an articulation 8 which has a swivel axis 9 aligned parallel to the vertical axis 5 of the superstructure 2. The counterweight 7 is connected with the articulation 8 via an arm 10. The articulation 8 can, for example, be a known multiple-shear pin connection.

Figure 6:
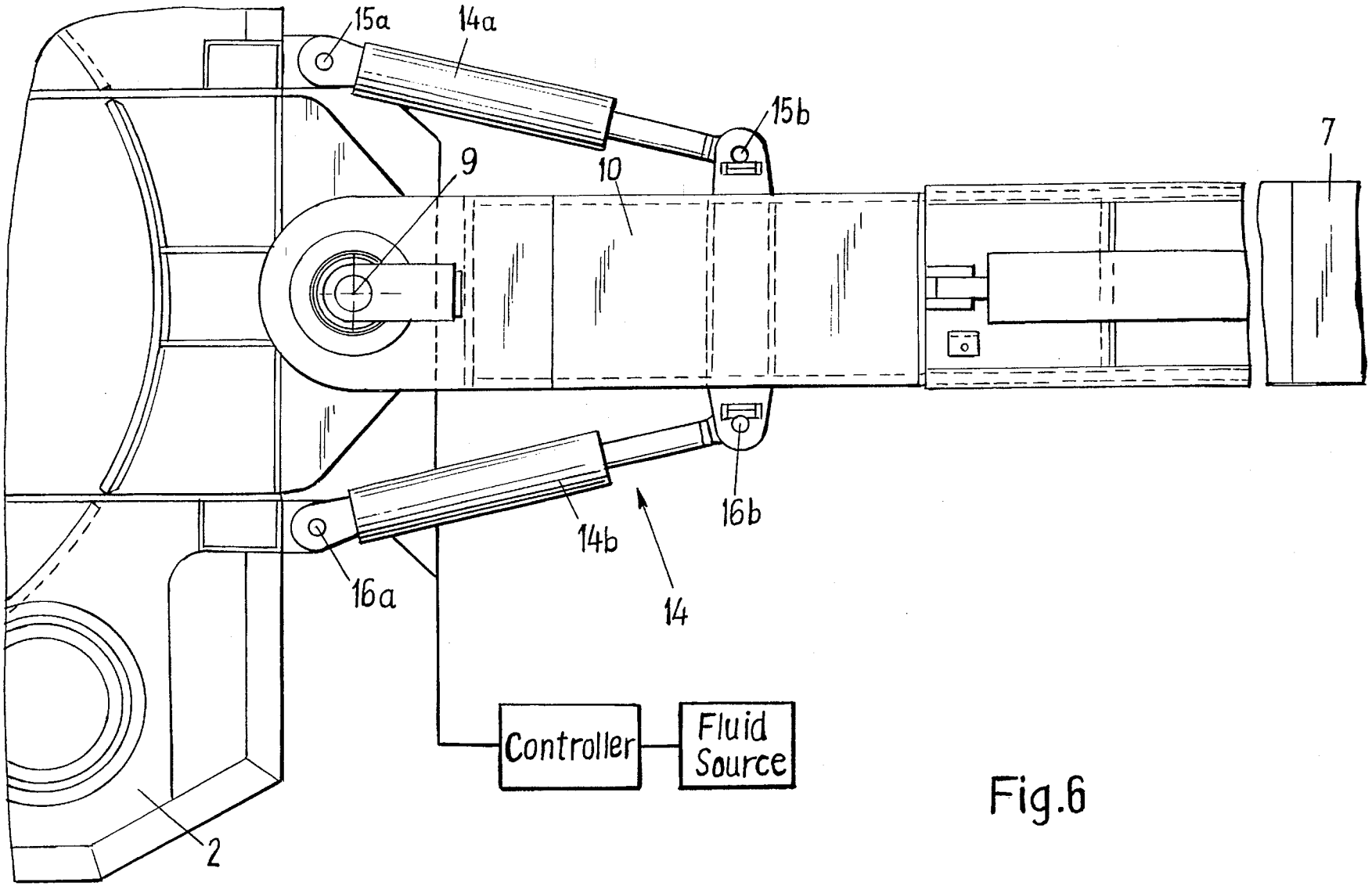
FIG. 6 shows a detail view of the swivel connection between the counterweight and the superstructure.

Furthermore, a driver's cab 11 is arranged on the superstructure 2 at the end of the superstructure 2 remote of the counterweight 7. The swiveling drive 14 of the counterweight 7 is shown in FIG. 6. The swiveling drive includes hydraulic cylinders 14*a*, 14 *b* which are connected between the superstructure 2 and the counterweight 7 by joints 15*a*, 15*b* and 16*a*, 16*b*. The cylinders are electronically controlled by a controller so that the difference between the swivel angle of the counterweight and the swivel angle of the super structure is always 0. For example, when the superstructure pivots 20° to the left the counterweight pivots 20° in the opposite direction. The angle can be determined by known devices such as pivot angle potentiometers and is converted in a known manner in an elevation unit to a signal which is used for controlling the flow of hydraulic fluid from a fluid source to the cylinders 14*a*, 14*b*. The limiting of the swivel angle is accomplished by the electronic control, and beyond this, the maximum swivel angle is limited by the maximum extension of the hydraulic cylinder and equals the degree of pivot of the crane.

Figure 2:
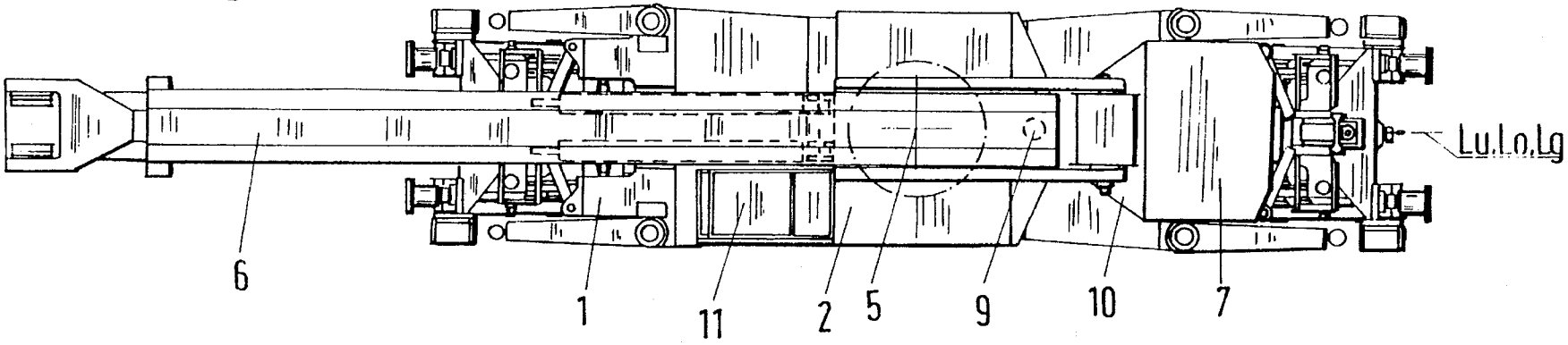
FIG. 2 shows a top view of FIG. 1.

FIG. 2 shows a top view of FIG. 1. The superstructure 2 is in the rest or transporting position, i.e. the swivel angle between the longitudinal axis Lo of the superstructure 2 and the longitudinal axis Lu of the undercarriage 1 is 0°. In the transporting position, the longitudinal extension Lg of the counterweight 7 is arranged in the extension or projection of the longitudinal axis Lo of the superstructure 2. Moreover, it can be seen that the vertical axis 5 for the swiveling of the superstructure 2 and the swivel axis 9 of the counterweight 7 intersect the longitudinal axis Lo of the superstructure 2.

Figure 3:
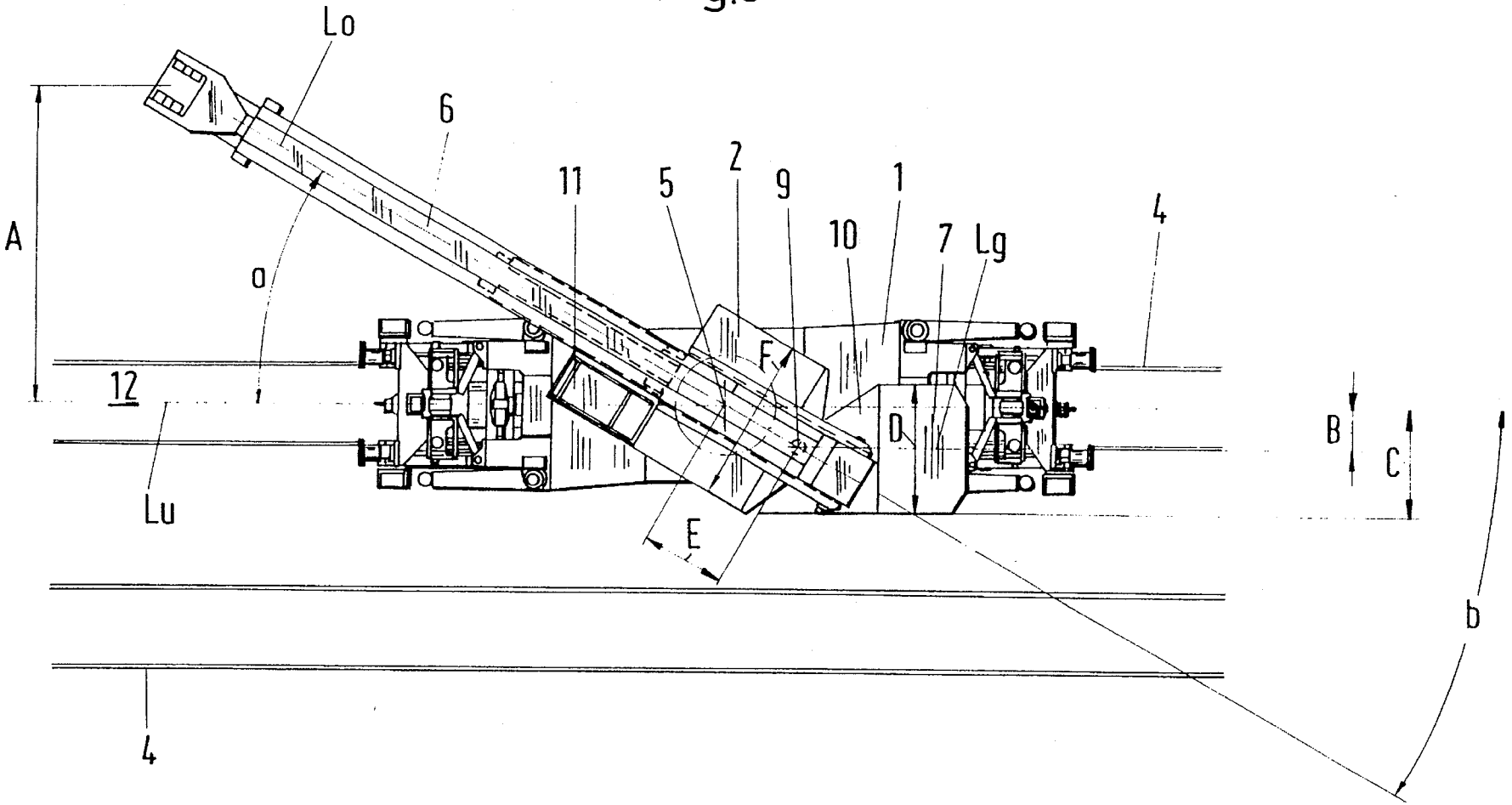
FIG. 3 shows a top view of FIG. 1 with a superstructure in swiveled position.

FIG. 3 shows a superstructure 2 according to FIG. 2 in a position which is swiveled by an angle a. The angle a is enclosed by the longitudinal direction Lo of the superstructure 2 and a plane passing through the longitudinal direction Lu of the undercarriage 1. The counterweight 7 is swiveled by a swivel angle b which is enclosed by the longitudinal axis Lo of the superstructure 2 and the longitudinal axis Lg of the counterweight 7. The superstructure 2 and counterweight 7 swivel in opposite directions. The width D of the counterweight 7 is selected so that, at a preselected maximum swivel angle a, the outer contour of the superstructure 2, with the width F of the jib 6 and counterweight 7, is located within the clearance gauge of the rail path, whose width is described by C between the center of the track and the lateral plane of the clearance gauge. Similarly, the distance E describing the distance between the vertical axis 5 and the swivel axis 9 is adapted to the maximum swivel angle a. Accordingly, in the embodiment shown the railway crane can swivel up to a swivel angle a of approximately 30° without the counterweight 7 exceeding the width C of the clearance gauge which amounts to approximately 2 m. Accordingly, at a jib length of approximately 12 m, the load can be picked up to a distance A of approximately 6 m from the center of the rails. In this swiveling position, the angle b is −30° .

Figure 4:
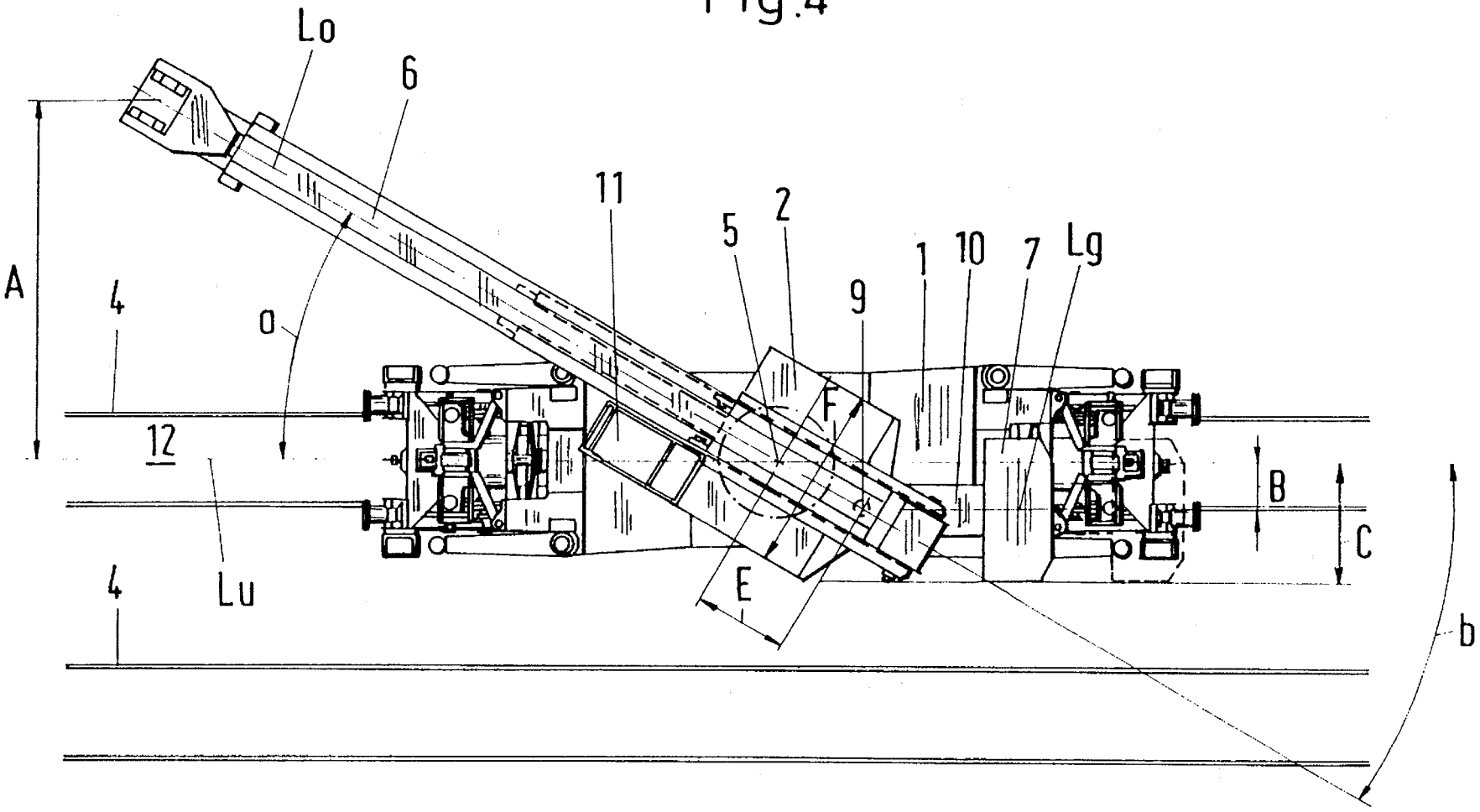
FIG. 4 shows a top view of a railway crane with a counterweight which can move out horizontally.

A railway crane, according to the invention, with a counterweight 7 which can be moved out horizontally is shown in FIG. 4. The counterweight 7 can be moved out parallel to the longitudinal axis Lu of the undercarriage 1 by means of a telescoping arm 10. It can be seen that an effective increase in the counterweight moment is achieved without departing from the width C of the clearance gauge at the preselected swivel angle a.

Figure 5:
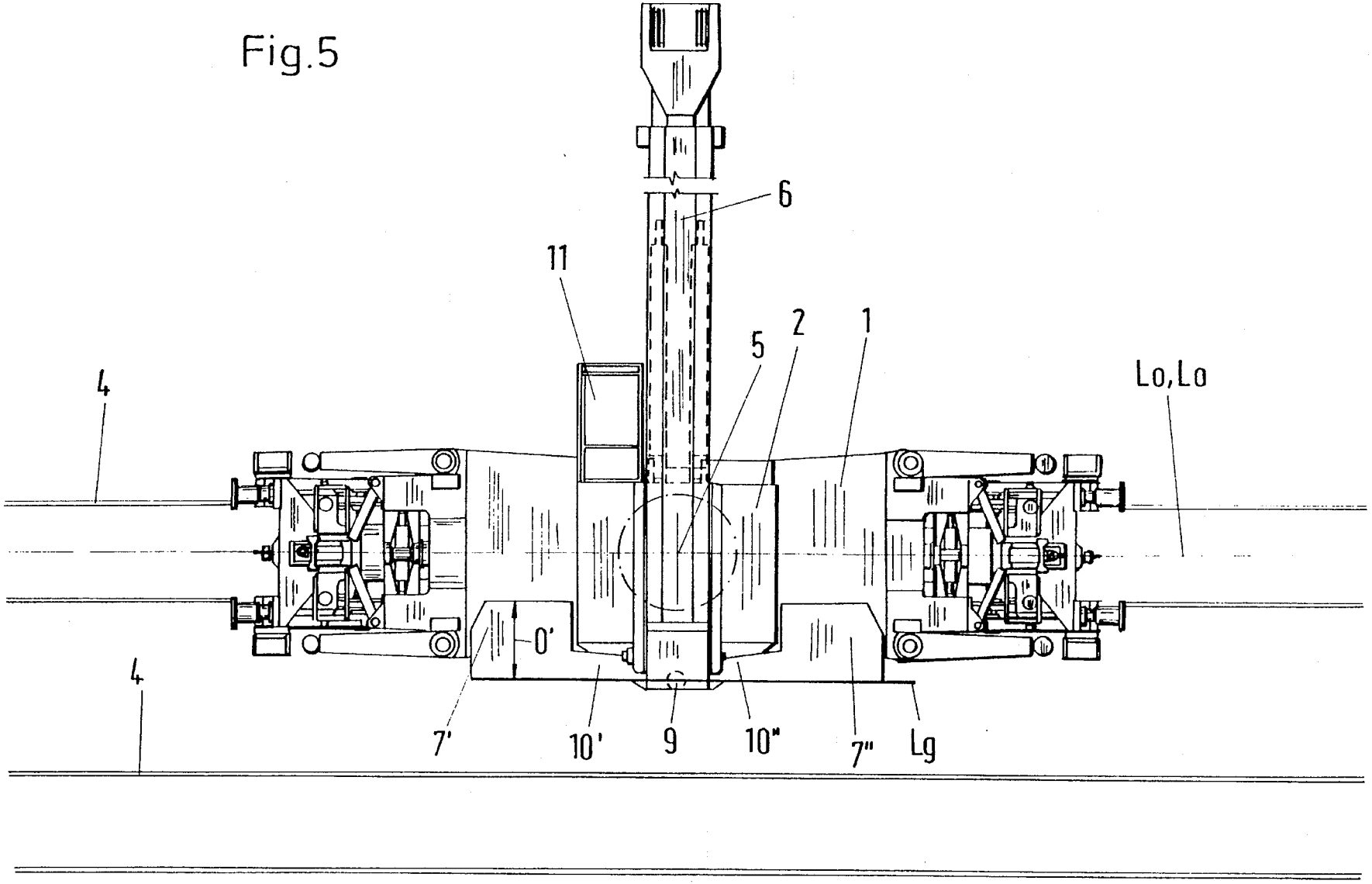
FIG. 5 shows a top view of a railway crane with longitudinally divided and folded up counterweight and with a superstructure which is swiveled by 90° relative to the undercarriage.

FIG. 5 shows a top view of a railway crane with a counterweight 7 which is divided along its longitudinal axis Lg. The parts 7', 7" of the counterweight 7 are connected by their arms 10', 10" with the rear side of the superstructure 2 via the swivel axis 9. The articulation 8 extending through the swivel axis 9 is constructed as a multiple-shear pin connection so as to enable the two parts 7, 7" to swivel in the same direction according to FIG. 3 without the counterweight 7 being divided. It can be seen from FIG. 5 that the railway crane according to the invention also has a reduced rear length at a swivel angle a of 90° and with parts 7', 7" of the counterweight 7 which are simultaneously folded up parallel to the longitudinal axis of the undercarriage.

The invention is not limited by the embodiments described above which are presented as examples only but can be modified in various ways within the scope of protection defined by the appended patent claims.

We claim:

1. A railroad crane, comprising:

an undercarriage adapted to travel on rails;

a superstructure having a longitudinal axis and arranged on the undercarriage so as to be swivelable around a vertical axis;

a jib;

at least one counterweight pivotably mounted to the superstructure so as to be pivotable responsive to swiveling movement of the superstructure, the at least one counterweight being mounted to the superstructure by an articulation which has a swivel axis aligned parallel to the vertical axis, the counterweight being. arranged so that the swivel axis thereof always intersects the longitudinal axis of the superstructure and is at a distance from the vertical axis of the superstructure toward a rear side of the superstructure remote of a free end of the jib; and swivel drive means arranged between the superstructure and the counterweight for driving the counterweight opposite to the swiveling direction of the superstructure.

2. A crane according to claim 1, wherein the undercarriage and the counterweight each have a longitudinal axis, the longitudinal axis of the superstructure and the longitudinal axis of the undercarriage enclosing a first swivel angle and the longitudinal axis of the superstructure and the longitudinal axis of the counterweight enclosing a second swivel angle, the swivel drive means being adapted to drive the counterweight so that the first and second swivel angles are equal in amount in a transporting position of the crane and in a preselected maximum swivel position in which the swivel angles are between 20° and 40°.

3. A crane according to claim 2, wherein the swivel drive means is adapted to be controllable as a function of the first swivel angle of the superstructure so that the swivel drive means is operative to maintain the second swivel angle of the counterweight equal in amount to the first swivel angle of the superstructure in every swiveling position of the superstructure.

4. A crane according to claim 1, wherein the counterweight and the superstructure each have a width, a ratio of the width of the counterweight and the width of the superstructure and the distance between the vertical axis and the swivel axis being selected so that an outer contour of the superstructure and counterweight are arranged within a half width of a clearance gauge of a travel path of the crane at a preselected maximum swivel angle of the superstructure.

5. A crane according to claim 4, wherein the counterweight has an at least approximately square shape with a side wall facing a lateral plane of the clearance gauge and extending parallel to the lateral plane of the clearance gauge in a swiveling position with the maximum swivel angle.

6. A crane according to claim 1, and further comprising an extendable arm that connects the counterweight with the articulation.

* * * * *